US006379858B1

(12) United States Patent
Perry et al.

(10) Patent No.: US 6,379,858 B1
(45) Date of Patent: Apr. 30, 2002

(54) SONIC HONING OF SUBSTRATES

(75) Inventors: Philip G. Perry, Webster; Gene W. O'Dell; William G. Herbert, both of Williamson; Alexander A. Antonelli, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 61 days.

(21) Appl. No.: 09/637,634

(22) Filed: Aug. 14, 2000

(51) Int. Cl.[7] ..... G03G 5/10
(52) U.S. Cl. ..... 430/127; 399/276; 451/165
(58) Field of Search ..... 430/127; 399/276; 451/165

(56) References Cited

U.S. PATENT DOCUMENTS 4,122,603 A * 10/1978 Sastri ..... 30/346.5
4,265,990 A 5/1981 Stolka et al. ..... 430/59
4,298,697 A 11/1981 Baczek et al. ..... 521/27
4,338,390 A 7/1982 Lu ..... 430/106
4,560,635 A 12/1985 Hoffend et al. ..... 430/106.6
5,483,326 A * 1/1996 Kosmider ..... 355/245
5,891,594 A 4/1999 Yuh et al. ..... 430/71
5,919,594 A * 7/1999 Perry et al. ..... 430/127
5,958,638 A 9/1999 Katayama et al. ..... 430/65
6,048,657 A * 4/2000 Herbert et al. ..... 430/127

* cited by examiner

*Primary Examiner*—John Goodrow

(57) ABSTRACT

A honing means produces sonic waves that suspend and propel a honing medium against a surface of a substrate. The honing medium impinges on the surface of the substrate and alters the substrate's surface roughness. The substrate and the honing means are positioned relative to each other to ensure substantial surface roughness uniformity.

35 Claims, 3 Drawing Sheets

SONIC HONING OF SUBSTRATES

BACKGROUND OF THE INVENTION

1. Field of Invention

The present invention relates to systems and processes for honing substrates to obtain desired substrate surface roughness, and honed substrates produced thereby, such as electrophotographic imaging members.

2. Description of Related Art

There are several known methods for processing substrates to obtain a desired substrate surface roughness. Although many of these known methods are effective, many of them are uneconomical or ineffective in certain applications.

Generally, manufacturers strive to produce a substrate surface roughness that is tailored for a specific application. For instance, when preparing the surface of a substrate prior to coating the substrate with organic materials to produce an organic photoreceptor, manufacturers of electrophotographic imaging systems often roughen the surface of the substrate so that it is less reflective. A non-reflective substrate surface is beneficial in electrophotographic imaging because it minimizes an imaging defect known as "plywooding", which is caused by light interference patterns commonly associated with relatively smooth, reflective substrate surfaces.

Anodization is one method manufacturers have used to minimize substrate surface reflectance. Unfortunately, although anodization reduces plywooding, it does not eliminate the problem entirely. Another method used by manufacturers to minimize plywood image defects is rough lathing. However, like anodization, rough lathing does not entirely eliminate plywooding problems, and it is only marginally successful in specific applications.

Substrate honing is another common substrate surface treatment for minimizing surface reflectance. Conventional substrate honing processes use abrasive media to roughen a substrate's surface to eliminate the interference patterns that cause plywooding defects. Often, high pressure air is used to propel a slurry of silica and water against the substrate surface. Typically, the substrate is submerged in a slurry bath and is positioned to ensure surface roughness uniformity. Although conventional honing is effective, it is a relatively costly process.

Because conventional honing systems require high-pressure air to blast the substrate surface with abrasive media, these systems require several high cost components including high powered pumps, specialized valves and extensive support facilities to monitor and maintain process conditions. In addition to the relatively high equipment cost, system maintenance can also be costly. Moreover, because of the large size of the equipment used for high pressure honing, conventional honing systems typically occupy a fairly large amount of floor space.

SUMMARY OF THE INVENTION

The present invention provides an economical alternative to conventional honing and surface roughening systems. The honing system of the present invention uses sonic waves to propel abrasive media against a substrate's surface to achieve a desired substrate surface roughness. By controlling system variables including, for example, sonic frequency, system temperature, sonic amplitude and the type of abrasive media used, operators can use the present system to effectively modify substrate surface roughness.

The present invention also provides an improved honing method, and materials produced thereby. The methods and systems of the present invention are particularly suitable for honing a variety of substrates, such as substrates useful for fabricating electrophotographic imaging members.

The present invention offers several advantages over conventional honing systems. First, because the present invention uses smaller and less complex equipment, it is less expensive than conventional honing systems and occupies less floor space. Another advantage of the present invention is that it can perform substrate surface honing using reduced media velocities. By reducing the average velocity of the abrasive media, the present invention produces less energetic collisions between the abrasive media and the substrate, and thereby reduces the incidence of media inclusions and fracturing. By reducing media inclusions and fracturing, the present invention can extend the life of the abrasive media and can simplify post-process clean-up. Moreover, because the present invention experiences less equipment wear and can keep media suspended more easily than conventional honing systems, the present invention also allows users to select from a larger variety of abrasive media. The present invention also provides users with more process variables that they can adjust during processing to produce a specific substrate surface roughness. Also, because the present invention does not require a high pressure air stream to direct the abrasive media against the substrate's surface during processing, the present invention does not suffer from the top to bottom pressure variations and related surface uniformity problems commonly associated with conventional high pressure honing processes. Finally, because the present invention uses a less complex sonic propulsion system, the present invention does not require the extensive support facilities that are necessary in conventional high pressure honing to monitor and maintain process conditions.

DETAILED DESCRIPTION OF PREFERRED EMBODIMENTS

The honing system of the present invention provides the above-mentioned advantages over conventional high pressure honing systems by using a sonic direction control device, instead of a high pressure air stream, to suspend and propel abrasive media against a substrate's surface.

Although the honing system of the present invention is not limited to any particular embodiment, each embodiment generally includes an arrangement of basic components. In its most common form, the present invention is generally comprised of a processing tank or vessel, a honing medium, a means for holding a substrate in place, and a sonic honing means to generate sonic waves to suspend and propel the honing medium in the solution to impinge on the substrate's surface.

Figure 1:
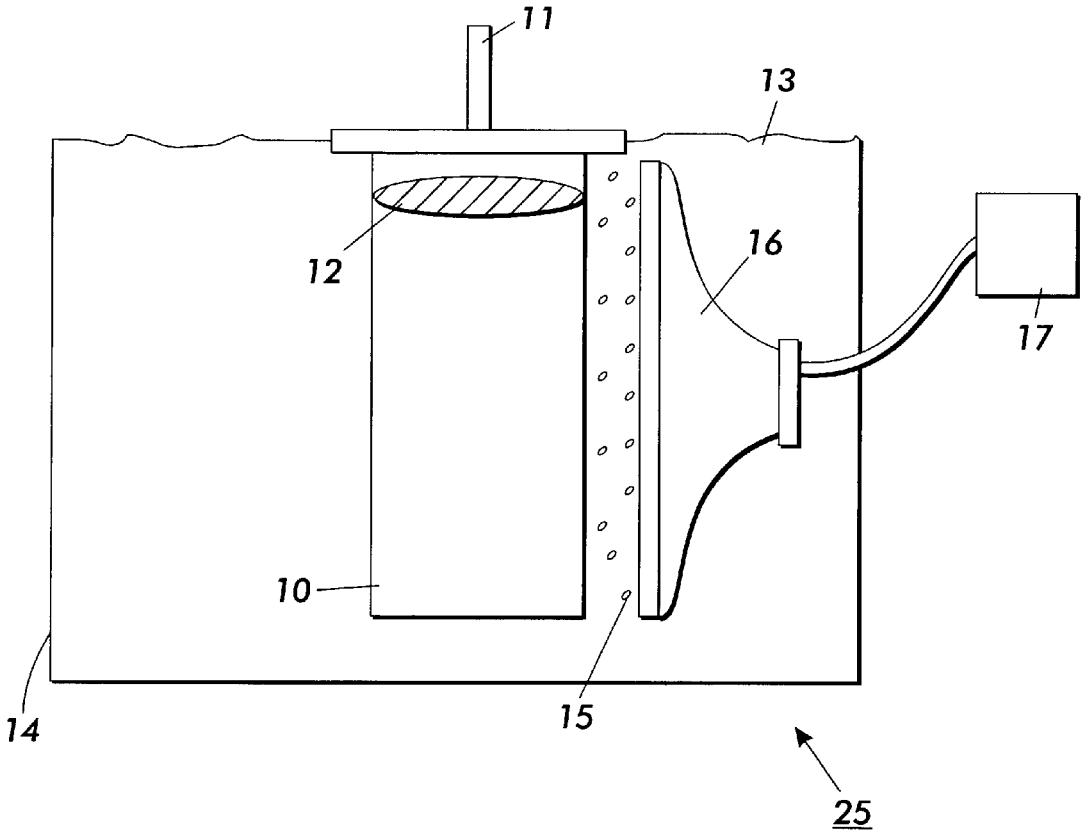
FIG. 1 is a schematic view of an exemplary embodiment of a sonic substrate surface honing system according to this invention.

An exemplary embodiment of a sonic honing system 25 according to the present invention is depicted in FIG. 1. In this embodiment, a substrate 10 is connected to a chucking system 11 with a rubber bladder 12. The chucking system 11 holds the substrate 10 firmly in place and ensures that the substrate 10 is sufficiently submerged in a liquid slurry 13 contained within a rubber lined processing vessel 14. Abrasive media 15 within the liquid slurry 13 are then suspended and propelled by sonic waves emitted from a sonic horn 16 positioned within the processing vessel 14 and submerged within the liquid slurry 13. To ensure that the surface roughness of the substrate 10 is uniform, the chucking system 11 in this embodiment rotates the substrate 10 so that the entire surface of the substrate 10 receives a relatively equal amount of processing. Finally, a variable frequency sonic generator 17 is used to generate the sonic waves emitted by the sonic horn 16.

The honing system of the present invention may be comprised of various interchangeable components, such as but not limited to those described below, all of which are suitable for the present invention. For instance, although there are many types of chucking systems that may be suitable for positioning a substrate during honing, we have found that a chucking system having a rubber covered rotating spindle and tube holding chuck performs adequately. Chucking systems of this type are relatively inexpensive and reliable, and are well suited for holding and positioning cylindrically shaped substrates (commonly used in the manufacture of electrophotographic imaging system photoreceptors) during honing. Alternatively, the substrate can be held by a chucking system that grasps the substrate at both ends and preferably seals openings at the ends to minimize media contact with the inside of the substrate. The above alternative chucking system can also minimize media entrapment and carryover to subsequent process steps, so that potential foreign material defects are avoided in a device that later incorporates the substrate. Other suitable chucking systems will be apparent to those of ordinary skill in the art and can be readily used in the present invention.

Moreover, although the chucking system 11 of FIG. 1 holds and rotates the substrate 10 relative to the sonic horn 16 to ensure surface roughness uniformity, a stationary chucking system could also be used in conjunction with multiple sonic direction control devices, such as two or more, three or more, four or more, etc., positioned relative to the substrate to ensure substantial surface roughness uniformity. Furthermore, it is also possible to maintain the position of the substrate while moving the sonic direction control device(s) relative to the substrate, or to simultaneously move the substrate and the sonic direction control device(s) relative to each other to achieve desired surface roughness uniformity.

There are also several suitable sonic direction control devices that can be used to suspend and propel abrasive media. One suitable device includes a sonic horn driven by a variable frequency sonic generator. A variable frequency sonic generator-driven horn can produce sonic waves having a frequency of for example, between about 10 KHz and about 100 KHz, preferably between about 20 KHz and about 40 KHz. Moreover, because variable frequency generators can be easily adjusted to cause a horn to produce different frequencies and amplitudes, an operator or automated controller using such a system can easily adjust these wave characteristics to produce a specific surface roughness. Although the above-described sonic direction control device is adequate, other devices having comparable specifications may also be used to perform sonic honing in accordance with the present invention.

In addition, even though there are many different liquids that can be used for the system slurry, water, preferably maintained at between about 20 and about 40° C., and more preferably between about 25 and about 35° C., serves as a suitable liquid within which to perform sonic honing in accordance with the present invention. Water is an ideal liquid because it is readily available and inexpensive. Although water is a suitable liquid for the present invention, other liquids having comparable physical properties may also be suitable. Other suitable liquids can include, but are not limited to, aqueous salt solutions and/or aqueous solutions containing surfactants and/or suspending agents to increase buoyancy and assist in media suspension. Examples of suitable salts include, but are not limited to, carbonate, bicarbonate, sulfate and phosphate salts of alkali and alkaline earth metals, mixtures thereof and the like. Suitable suspending agents include, but are not limited to, sodium carboxymethylcellulose, bentonite, polyacrylic acid polymers, mixtures thereof and the like. Suitable surfactants can include, but are not limited to, block polymers and copolymers of ethylene oxide and/or propylene oxide, ethoxylated alcohols, glycol esters, mixtures thereof and the like.

Also, in order to ensure adequate substrate surface honing, it is important to select a substrate that is sufficiently malleable, or that exhibits a sufficient yield strength. Although several substrates are suitable for honing in accordance with the present invention, preferred substrates exhibit a yield strength in the range of from about 5,000 to about 20,000 psi.

Finally, there are also several suitable varieties and sizes of abrasive media that can be used in conjunction with a sonic direction control means to accomplish sonic substrate honing according to the present invention. For example, in embodiments of the present invention, microsized silica particles or glass beads on the order of between about 10 to about 100 microns, and more preferably about 20 to about 40 microns are suitable varieties of abrasive media. By using microsized abrasive particles, sonic waves having a frequency of about 20 to about 40 KHz can be used to propel the particles for a duration of approximately 10–100 seconds, and more preferably between about 15 and about 30 seconds to obtain an approximate surface roughness of from about 0.1 to about 0.5 microns, and more preferably between about 0.15 and about 0.25 microns. In addition, because silica is relatively inexpensive and resistant to fracture, silica particles have a relatively long processing life. Of course, although microsized silica particles and glass beads are suitable types of abrasive media, particles of other materials having similar physical properties and particle sizes may also be used. Examples of suitable alternative materials include, but are not limited to, alumina, zirconia, steel shot, garnet, quartz, silicon carbide, and the like.

In embodiments, a suitable transport media may be used without including a specific particulate honing media. Thus, for example, the honing medium contained in the processing vessel may be substantially or completely free of particulate material, and may include substantially or entirely only a processing liquid. Such suitable liquids include those described above for the system slurry, such as water. By not using an insoluble media, subsequent coating defects and defective products due to media entrapment can be avoided.

According to the present invention, the above-described apparatus can be used in a process for honing substrate surfaces. Generally, this process includes the steps of submerging the substrate in a processing vessel, honing the surface, and removing the honed substrate from the processing vessel. To provide a uniform surface, the substrate is preferably completely submerged in the processing liquid.

However, if desired for particular applications, the substrate can be only partially immersed in the liquid. This would achieve honing of only a portion of the substrate surface.

Figure 2:
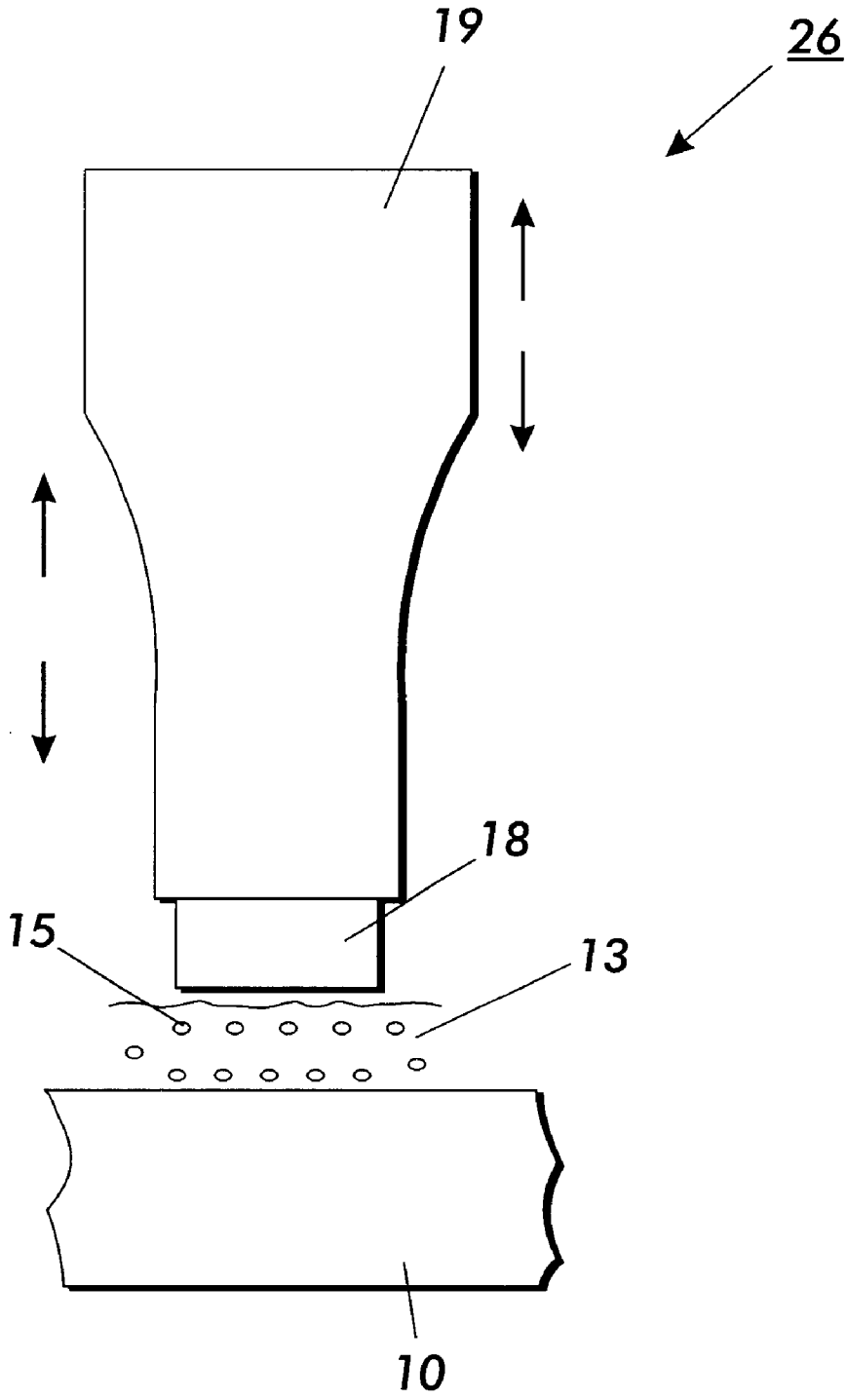
FIG. 2 is a schematic view of one alternative embodiment of a sonic substrate honing system according to this invention.

One alternative embodiment of the honing system according to the present invention is depicted in FIG. 2. In this embodiment, the system 26 comprises a horn 19, a cutting tool 18, a liquid slurry 13, and an abrasive medium 15. In this embodiment, the system 26 operates in a manner similar to stationary processing equipment manufactured and sold by SONIC-MILL$^{sm}$. The system 26 uses a power supply (not shown) that converts conventional line voltage to 20 KHz electrical energy. The high-frequency electrical energy is provided to a piezoelectrical converter (not shown). The piezoelectrical converter converts the high-frequency electrical energy into mechanical motion. Sonic motion from the converter is amplified and transmitted to the horn 19 and cutting tool 18. As a result, the horn 19 and the attached cutting tool 18 vibrate perpendicularly to the surface of the substrate 10 thousands of times per second with no side to side motion. The liquid 13 and the abrasive media 15 are introduced between the vibrating tool 18 and the substrate 10 by a pump (not shown). The abrasive media 15 are smashed against the surface of the substrate 10 by the vibrating tool 18 so that the abrasive media 15 strike the substrate surface at a force that is several thousand times their own weight. The violent impingement of the abrasive media 15 against the surface of the substrate 10 can substantially roughen the surface of the substrate 10. Moreover, by appropriately positioning the vibrating tool 18 and the substrate 10 relative to each other, surface roughness uniformity can be achieved.

Figure 3:
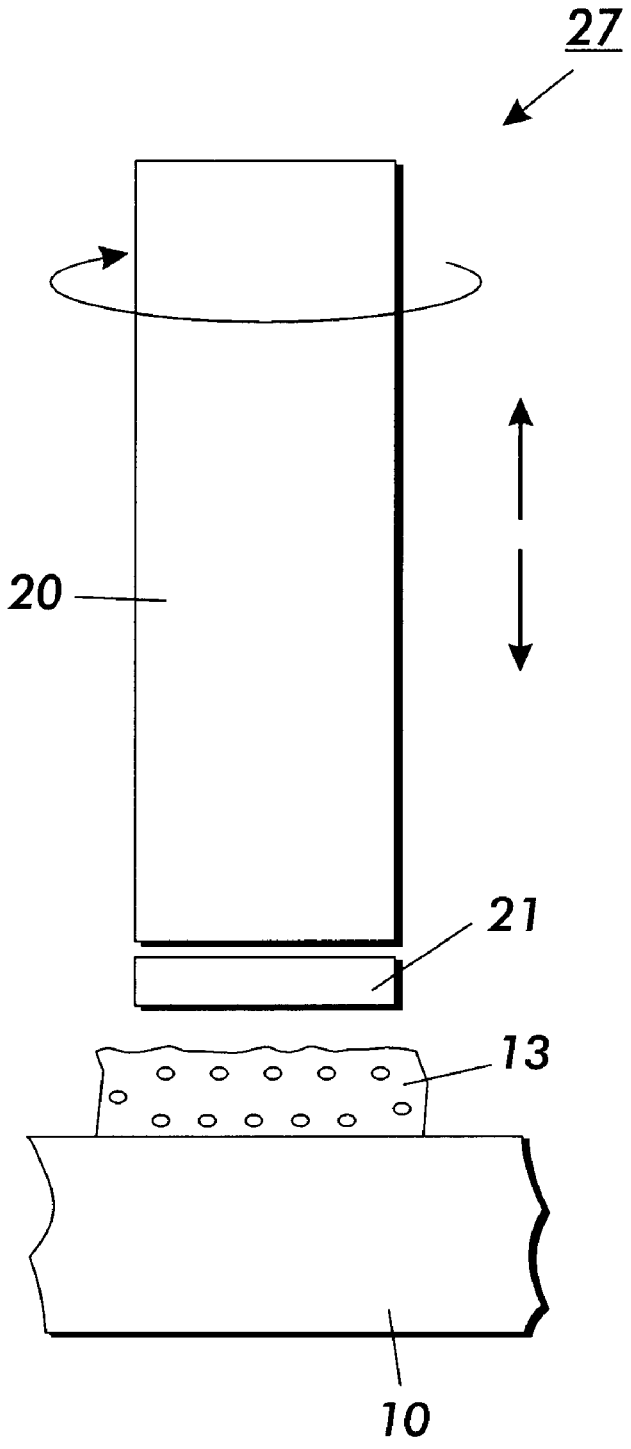
FIG. 3 is a schematic view of one alternative embodiment of a sonic substrate honing system according to this invention.

Another alternative embodiment of the present invention is depicted in FIG. 3. In this embodiment the sonic honing system 27 comprises a rotating horn 20, a cutting tool 21, and a liquid slurry 13. The system 27 of this embodiment operates in a manner similar to rotary processing equipment manufactured and sold by SONIC-MILL$^{sm}$. Like system 26, system 27 uses a power supply (not shown) to generate a high frequency (20 KHz) electrical signal that is applied to a piezoelectric converter (not shown). The converter changes the signal to mechanical motion coupled to the rotating horn 20 that holds the tool 21. The horn 20 can expand and contract approximately 0.002" at a rate of about 20,000 times per second, causing the tool 21 to vibrate longitudinally. The tool 21 can be a diamond tool that is either plated or impregnated. Also, the rotary motion of the tool 21 can vary from 0–4,000 rpm. The rotary and the sonic longitudinal motion of the tool 21 can substantially roughen the surface of the substrate 10. Finally, by introducing the liquid 13 between the tool 21 and the surface of the substrate 10, the liquid 13 cools the substrate 10 and the tool 21 during processing while working in conjunction with the moving tool 21 to provide self-cleaning to eliminate tool or core binding. Again, surface roughness uniformity can be substantially ensured by properly positioning the tool 21 and the substrate 10 during processing.

In the above alternative embodiments of the present invention, substrate honing can be accomplished by positioning the horn and cutting tool relative to the substrate, so that a slurry and/or an abrasive medium are introduced between the cutting tool and the substrate surface without submersing the substrate in a honing medium.

According to the present invention, the surface of the substrate is honed to provide any desired degree of surface roughness, preferably between about 0.1 and about 0.5 microns, and more preferably between about 0.15 and about 0.25 microns. Preferably, the honing is sufficient to provide a surface for an imaging member that eliminates, completely or substantially, the "plywooding" problem common in such imaging members produced by other processes.

In embodiments of the present invention where the honing system and/or method is applied to an imaging member substrate, the honing system and/or method can be used as a stage of an overall imaging member production process or processes. For example, in such processes, the imaging member can be processed by the honing system or process of the present invention to provide a suitable roughened surface to the imaging member substrate. The imaging member substrate can then be processed according to any of the suitable and well-known imaging member production processes, whereby one or more imaging layers are applied to the substrate. Such imaging member layers include, but are not limited to, an electrical ground plane, a blocking layer, a charge generating layer, a charge transport layer, an overcoating layer, one or more adhesive layers, an anti-curl backing layer, and the like. Preferably, in embodiments of the present invention, at least a charge generating layer is applied over the substrate, and a charge transport layer is applied over the charge generating layer. Suitable imaging member production processes are disclosed in, for example, U.S. Pat. Nos. 4,265,990, 4,298,697, 4,338,390, 4,560,635, 5,891,594, and 5,958,638, the entire disclosures of which are incorporated herein by reference.

The processes of the present invention may be used on a variety of substrate configurations. For example, while the processes of the present invention are particularly suitable for honing surfaces of cylindrical drums, the present invention is equally suitable to other substrate configurations including, but not limited to, endless belts. Furthermore, many suitable substrate materials are known and can be used in embodiments of the present invention. For example, suitable substrate materials include, but are not limited to, aluminum, nickel, steel, iron, copper, tin, zinc, mixtures thereof and the like.

Regardless of the specific arrangement and selection of system components, the sonic honing system and process of the present invention offers several important advantages over conventional high pressure honing systems.

One of the most significant advantages of the present invention is cost. Typically, conventional high pressure honing systems are sold at between $200,000 and $2,000,000. In contrast, a simple embodiment of the present invention will likely sell at a price of around $100,000 to $500,000. In addition to having a lower overall retail cost, the present invention will likely require less servicing than conventional systems and will therefore be less expensive to maintain.

Another important advantage of the present invention is its ability to accomplish substrate surface honing using minimized media/substrate surface collisions. In conventional honing systems, abrasive media are propelled by high pressure air and impinge on the substrate's surface with much greater force than in the system of the present invention. Although the high force impingement produced during conventional honing is effective in altering substrate surface roughness, it also produces high energy collisions that cause media inclusions and fracturing. As a result, the processing life of the abrasive media used in conventional honing processes is significantly limited. Moreover, because of the increased incidence of media inclusions and fractures produced during conventional honing procedures, post-process cleaning is also more problematic. In contrast, since the present invention can accomplish substrate surface honing using reduced particle velocities that produce less energetic media/substrate surface collisions, the present invention can significantly extend the processing life of the abrasive media used and can make post-process clean-up less problematic.

Furthermore, the high pressure air streams typically used in conventional substrate honing systems suffer from several disadvantages. For instance, the use of high pressure air is known to promote rapid deterioration of honing equipment including blasting guns, nozzles, hoses, etc. Moreover, circulation of a slurry through a honing device can promote deterioration of pumping system components including pumps, pipe lines, cabinets, etc. Furthermore, efforts to modify these systems to reduce wear and to improve longevity are impractical because of the high equipment costs associated with such modifications.

Unlike conventional honing systems that only offer operators a limited number of adjustable process variables, the present invention offers operators several process variables that can be adjusted during honing to produce a desired substrate surface roughness. The availability of these additional process variables makes it easier for operators to produce a specific surface roughness. For instance, the present invention allows the operator to select from a wide range of abrasive media, and provides the operator with a means to control sonic frequency, sonic amplitude and system temperature to control average media velocity and minimize the severity of media/substrate surface collisions. In contrast, in conventional honing systems it is necessary to control pressures, flow rates, concentrations and temperatures.

Another advantage of the present invention is that it eliminates top to bottom pressure variation problems commonly encountered with conventional high pressure honing systems. Because it is difficult to produce a high pressure air stream that exhibits a substantially equal amount of pressure at all points along a substrate's surface, conventional high pressure honing systems often experience pressure variations during honing that can result in undesirable surface roughness variations. Because the present invention uses sonic waves instead of air pressure to propel and suspend abrasive media, the present invention ensures that the abrasive media collide with relatively equal force at all points along the surface of the substrate. By ensuring that the force of each media/substrate surface collision is substantially the same, the present invention is more capable of ensuring that the substrate's surface roughness is relatively uniform.

Finally, another benefit of using sonic waves instead of air pressure to propel and suspend abrasive media during substrate honing is that sonic propulsion systems do not require the extensive support facilities needed in high pressure honing systems to maintain process conditions. Because surface roughness uniformity produced by conventional high pressure honing is heavily dependent on the system's ability to produce a uniform stream of pressure over the surface of the substrate, it is imperative that any process conditions that may cause variations in pressure be controlled. Because even slight changes in system temperature or air pressure can produce substantial variations in the substrate's surface roughness, conventional high pressure honing systems must employ extensive support facilities to monitor and maintain process conditions to ensure that they remain within specific predetermined ranges during processing. Although the support facilities used in high pressure honing systems are relatively effective in monitoring and maintaining process conditions to ensure surface roughness uniformity, the additional equipment needed to provide this support significantly increases the overall size and cost of the system.

Once the substrate surface has been honed, the substrate may be processed in any of a wide variety of processes and systems to provide a desired final product. For example, in embodiments of the present invention where the substrate is to be used in forming an imaging member, the honed substrate can be processed according to any of the various methods to apply subsequent layers to the substrate to form the imaging member. Such subsequent layers include, but are not limited to, undercoating layers, adhesive layers, blocking layers, charge generating layers, charge transporting layers, surface layers, and the like. Of course, the present invention is in no way limited to producing imaging members, but rather is applicable to a wide variety of end-product applications.

While this invention has been described in conjunction with the specific embodiments described above, it is evident that many alternatives, modifications and variations are apparent to those skilled in the art. Accordingly, the preferred embodiments of this invention as set forth above are intended to be illustrative and not limiting. Various changes can be made without departing from the spirit and scope of the invention.

What is claimed is:

1. A honing system for roughening a surface of a substrate, the system comprising:

a. a processing vessel;

b. a honing media contained within the processing vessel;

c. means for supporting a substrate in the honing medium;

d. sonic honing means disposed in the processing vessel for directing sonic waves at said substrate when supported in the honing medium;

e. whereby the sonic waves propel the honing medium at the substrate to roughen the surface of the substrate; and f. whereby the honing system provides the substrate with a surface roughness of about 0.1 micron to about 0.5 micron.

2. The system of claim 1, wherein the honing means is a sonic direction control device comprising a sonic horn and a variable frequency sonic generator.

3. The system of claim 1, wherein the sonic honing means produces sonic waves having a frequency of between about 10 KHz and about 100 KHz.

4. The system of claim 1, wherein the honing media comprises silica particles.

5. The system of claim 1, wherein the honing media have an average particle size of about 10 to about 100 $\mu$m.

6. The method of claim 1, wherein the honing medium is a liquid slurry comprised of water and abrasive media.

7. The system of claim 1, wherein the means for supporting the substrate in the honing medium substrate is a chucking system.

8. The system of claim 7, wherein the chucking system comprises a rubber covered rotating spindle and a tube holding chuck.

9. The system of claim 1, wherein the means for supporting the substrate moves the substrate relative to the honing means.

10. A system for honing an imaging member substrate comprising:

a. a vessel;

b. a liquid contained within the vessel;

c. an abrasive media present in the liquid;

d. a holder to hold the substrate within the liquid;

e. a sonic direction control device positioned relative to the imaging member substrate so that sonic waves emitted from the device are directed toward a surface of the imaging member substrate; and f. whereby the sonic waves propel the honing medium at the substrate.

11. The system of claim 10, wherein the vessel is rubber lined.

12. The system of claim 10, wherein the liquid contained in the vessel is water.

13. The system of claim 10, wherein the abrasive media comprises silica particles.

14. The system of claim 10, wherein the abrasive media comprises particles having an average particle size of about 10 to about 100 $\mu$m.

15. The system of claim 10, wherein the holder is a chucking system.

16. The system of claim 10, wherein the sonic direction control device includes at least one sonic horn and a variable frequency sonic generator.

17. The system of claim 10, wherein the sonic waves have a frequency of between about 10 KHz and about 100 KHz.

18. A method of honing an imaging member substrate surface to obtain a desired surface roughness, the method comprising the steps of:

a. positioning an imaging member substrate in a processing vessel containing a honing medium; and b. honing a surface of the imaging member substrate by emitting sonic waves from a honing means to propel the honing medium toward said surface.

19. The method of claim 18, wherein the honing medium comprises liquid and an abrasive media within the liquid.

20. The method of claim 19, wherein the abrasive media are silica particles.

21. The method of claim 19, wherein the abrasive media have an average particle size of about 10 to about 100 $\mu$m.

22. The method of claim 19, comprising honing the surface of the substrate by propelling the abrasive media using the sonic waves so that the media impinge on the surface of the substrate.

23. The method of claim 18, wherein the sonic waves have a frequency of between about 10 KHz and about 100 KHz.

24. The method of claim 18, wherein the honing means comprises a sonic horn and a variable frequency sonic generator.

25. The method of claim 18, further comprising positioning the substrate in the processing vessel using a chucking system.

26. The method of claim 25, further comprising using the chucking system to move the substrate relative to the honing means.

27. The method of claim 18, wherein the substrate is an imaging member substrate.

28. A honed substrate produced by the process of claim 18.

29. A method of forming an imaging member comprising:

a. providing an imaging member substrate;

b. honing the imaging member substrate according to the method of claim 18; and c. applying a charge generating layer to the imaging member substrate.

30. A method of forming an imaging member comprising;

a. providing a substrate;

b. providing an apparatus comprising a sonic horn that produces sonic waves and a moveable cutting tool;

c. introducing a liquid slurry between said cutting tool and a surface of the substrate; and d. operating said apparatus so that said cutting tool moves relative to the surface of the substrate and the sonic waves propel the liquid slurry at the surface of the substrate in order to hone the surface of the substrate.

31. The method of claim 30, wherein the cutting tool is moved longitudinally with respect to the surface of the substrate to hone the surface of the substrate.

32. The method of claim 30, wherein the cutting tool is moved rotatably relative to the surface of the substrate to hone the surface of the substrate.

33. The method of claim 30, further comprising introducing an abrasive medium between said cutting tool and the surface of the substrate.

34. The method of claim 30, further comprising converting a high frequency electrical signal into mechanical motion using a converter, and using the mechanical motion to move the cutting tool relative to the surface of the substrate to hone the surface of the substrate.

35. The method of claim 30, wherein said cutting tool in moved longitudinally and rotatably relative to the surface of the substrate to hone the surface of the substrate.

* * * * *